United States Patent [19]

Coker et al.

[11] 4,191,618

[45] Mar. 4, 1980

[54] PRODUCTION OF HALOGENS IN AN ELECTROLYSIS CELL WITH CATALYTIC ELECTRODES BONDED TO AN ION TRANSPORTING MEMBRANE AND AN OXYGEN DEPOLARIZED CATHODE

[75] Inventors: Thomas G. Coker, Waltham; Russell M. Dempsey, Hamilton; Anthony B. LaConti, Lynnfield, all of Mass.

[73] Assignee: General Electric Company, Wilmington, Mass.

[21] Appl. No.: 922,289

[22] Filed: Jul. 6, 1978

Related U.S. Application Data

[63] Continuation-in-part of Ser. No. 863,798, Dec. 23, 1977, abandoned.

[51] Int. Cl.[2] ..... C25B 1/46; C25B 9/04; C25B 11/02; C25B 13/08

[52] U.S. Cl. ..... 204/98; 204/128; 204/282; 204/283; 204/290; 204/291

[58] Field of Search ..... 204/DIG. 3, 98, 128, 204/282, 283, 295, 296

[56] References Cited

U.S. PATENT DOCUMENTS

| | | | |
|---|---|---|---|
| 2,681,884 | 6/1954 | Butler | 204/98 |
| 3,528,858 | 9/1970 | Hodgdon et al. | 204/296 X |
| 3,809,630 | 5/1974 | De Nora et al. | 204/98 |
| 4,025,405 | 5/1977 | Dotson et al. | 204/98 |
| 4,035,254 | 7/1977 | Gritzner | 204/98 |
| 4,086,149 | 4/1978 | Martinsons et al. | 204/59 R |

*Primary Examiner*—F. C. Edmundson
*Attorney, Agent, or Firm*—I. D. Blumenfeld

[57] ABSTRACT

A halogen such as chlorine is generated by the electrolysis of aqueous halides in an electrolysis cell which includes an anode and a cathode separated by an ion transporting membrane. At least the cathode, which is a mass of noble metal catalytic particles and particles of a suitable binder, is bonded to the surface of the membrane. An oxygen containing gaseous stream is brought into contact with the bonded cathode to depolarize the cathode and prevent or limit discharge of hydrogen at the cathode, thereby substantially reducing the cell voltage.

25 Claims, 3 Drawing Figures

PRODUCTION OF HALOGENS IN AN ELECTROLYSIS CELL WITH CATALYTIC ELECTRODES BONDED TO AN ION TRANSPORTING MEMBRANE AND AN OXYGEN DEPOLARIZED CATHODE

This Application is a Continuation in Part of our Application Ser. No. 863,798, filed Dec. 23, 1977 now abandoned.

This invention relates generally to a process and apparatus for producing halogens by the electrolysis of aqueous halides in a cell having an oxygen depolarized cathode.

Chlorine electrolysis cells which include ion transporting barrier membranes have been previously used to permit ion transport between the anode and the cathode electrodes while blocking liquid transport between the catholyte and anolyte chambers. Chlorine generation in such prior art cells have, however, always been accompanied by high cell voltages and substantial power consumption.

In a recent application for U.S. Letters Patent, Ser. No. 858,949, filed Dec. 9, 1977, now abandoned, in the name of Anthony B. LaConti, et al entitled, "Chlorine Generation by Electrolysis of Hydrogen Chloride in a Cell Having a Solid Polymer Electrolyte Membrane with Bonded Embedded Catalytic Electrodes", which is assigned to the General Electric Company, the assignee of the present invention, a process and apparatus is described in which a hydrogen halide, i.e., hydrochloric acid, is electrolyzed and a halogen, i.e., chlorine, is evolved at the anode of a cell which contains a cation exchange polymer and catalytic electrodes which are in intimate contact with the surface of the ion transporting membrane. The electrodes are typically fluorocarbon bonded graphite electrodes activated with thermally stabilized, reduced oxides of platinum group metals such as ruthenium oxide, iridium oxide along with valve metal oxide particles such as titanium, tantalum, etc. These catalytic anodes and cathodes have been found to be particularly resistant to the corrosive hydrochloric acid electrolyte as well as to chlorine evolved at the anode. The process described in the LaConti, et al application is a substantial improvement over existing commercial processes and is accompanied by reductions in cell voltage ranging from 0.5 to 1.0 volts.

In yet another recent application for U.S. Letters Patent, Ser. No. 858,959, filed on Dec. 9, 1977, in the name of Coker, et al entitled, "Chlorine Production by Electrolysis of Brine in an Electrolysis Cell Having Catalytic Electrodes Bonded to and Embedded in the Surface of a Solid Polymer Electrolyte Membrane", which is assigned to the General Electric Company, the assignee of the present invention, a process and electrolysis cell is described in which an alkali metal halide, such as brine, is electrolyzed in a cell in which an anode and cathode electrode are in intimate physical contact with opposite sides of an ion exchanging membrane. This intimate contact is achieved preferably by bonding the electrodes to the surfaces of the membrane. By virtue of the intimate contact of electrodes with the membrane and the highly efficient electrocatalyst used in the electrodes, alkali metal chlorides are electrolyzed very efficiently at the cell voltages which represent a 0.5 to 0.7 volt improvement over existing commercial systems.

The arrangements for generating chlorine and other halogens from aqueous halides described in the aforesaid LaConti and Coker applications involve hydrogen evolution at the cathode. In hydrochloric acid electrolysis, hydrogen ions from the anode are transported across the membrane to the cathode and discharged as hydrogen gas. In brine electrolysis, water is reduced to produce hydroxyl ions ($OH^-$) and hydrogen gas at the cathode. Applicants have found that substantial additional reductions in cell voltage in the order of 0.6 to 0.7 volts may be realized by eliminating hydrogen evolution at the cathode. As will be pointed out in detail subsequently, this is achieved by oxygen depolarization of the cathode. Oxygen depolarization of the cathode results in the formation of water at the cathode rather than the discharge of hydrogen ions to produce gaseous hydrogen in an acid system. Since the $O_2/H^+$ reaction to form water is much more anodic than the hydrogen ($H^+/H_2$) discharge reaction, the cell voltage is reduced substantially; by 0.5 volts or more. This improvement is in addition to the reductions in cell voltage achieved by bonding at least one of the catalytic electrodes directly to the membrane as disclosed in the aforementioned LaConti and Coker applications.

It is therefore a principal objective of this invention to produce halogens efficiently by the electrolysis of halides in a cell utilizing an ion exchange membrane with bonded electrodes and an oxygen depolarized cathode.

It is another objective of this invention to provide a method and apparatus for producing halogens by the electrolysis of halides with substantially lower cell voltages than is possible in the prior art.

A further objective of this invention is to provide a method and an apparatus for producing halogens by the electrolysis of halides in which hydrogen discharge at the cathode is minimized or eliminated.

Still another objective of the invention is to provide a method and apparatus for producing chlorine from hydrogen chloride in a cell containing an ion exchange membrane and an oxygen depolarized cathode bonded to the surface of the membrane.

Still further objectives of the invention are to provide a method and apparatus for the production of chlorine by the electrolysis of an alkali metal chloride solution in a cell having an ion transporting membrane and an oxygen depolarized cathode bonded to a surface of the membrane.

Other objectives and advantages of the invention will become apparent as the description thereof proceeds.

In accordance with the invention, halogens, i.e., chlorine, bromine, etc., are generated by the electrolysis of aqueous hydrogen halides, i.e., hydrochloric acid, or aqueous alkali metal halides (brine, etc.) at the anode of an electrolysis cell which includes an ion exchange membrane separating the cell into catholyte and anolyte chambers. Thin, porous, gas permeable catalytic electrodes are maintained in intimate contact with the ion exchange membrane by bonding at least one of the electrodes to the surface of the ion exchange membrane. The cathode is oxygen depolarized by passing an oxygen containing gaseous stream over the cathode so that there is no hydrogen discharge reaction at the cathode. Consequently, the cell voltage for halide electrolysis is substantially reduced. The cathode is covered with a layer of hydrophobic material such as Teflon or with a Teflon containing porous layer. The layer prevents the formation of a water film which blocks oxygen from the catalytic sites. The layer has many non-interconnecting pores which break up the water film and allow oxygen in the gas stream to reach and depolarize the cathode thereby preventing or limiting hydrogen evolution.

The catalytic electrodes include a catalytic material comprising at least one reduced platinum group metal oxide which is thermally stabilized by heating the reduced oxides in the presence of oxygen. In a preferred embodiment, the electrodes include fluorocarbon (polytetrafluoroethylene) particles bonded with thermally stabilized, reduced oxides of a platinum group metal. Examples of useful platinum group metals are platinum, palladium, iridium, rhodium, ruthenium and osmium.

The preferred reduced metal oxides for chlorine production are reduced oxide of ruthenium or iridium. The electrocatalyst may be a single, reduced platinum group metal oxide such as ruthenium oxide, iridium oxide, platinum oxide, etc. It has been found, however, that mixtures or alloys of reduced platinum group metal oxides are more stable. Thus, one electrode of reduced ruthenium oxides containing up to 25% of reduced oxides of iridium, and preferably 5 to 25% of iridium oxide by weight, has been found very stable. In a preferred composition, graphite may be added in an amount up to 50% by weight, preferably 10–30%. Graphite has excellent conductivity with a low halogen overvoltage and is substantially less expensive than plantinum group metals so that a substantially less expensive, yet highly effective electrode is possible.

One or more reduced oxides of a valve metal such as titanium, tantalum, niobium, zirconium, hafnium, vanadium or tungsten may be added to stabilize the electrode against oxygen, chlorine, and the generally harsh electrolysis conditions. Up to 50% by weight of the valve metal is useful, with the preferred amount being 25–50% by weight.

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings in which:

Figure 1:
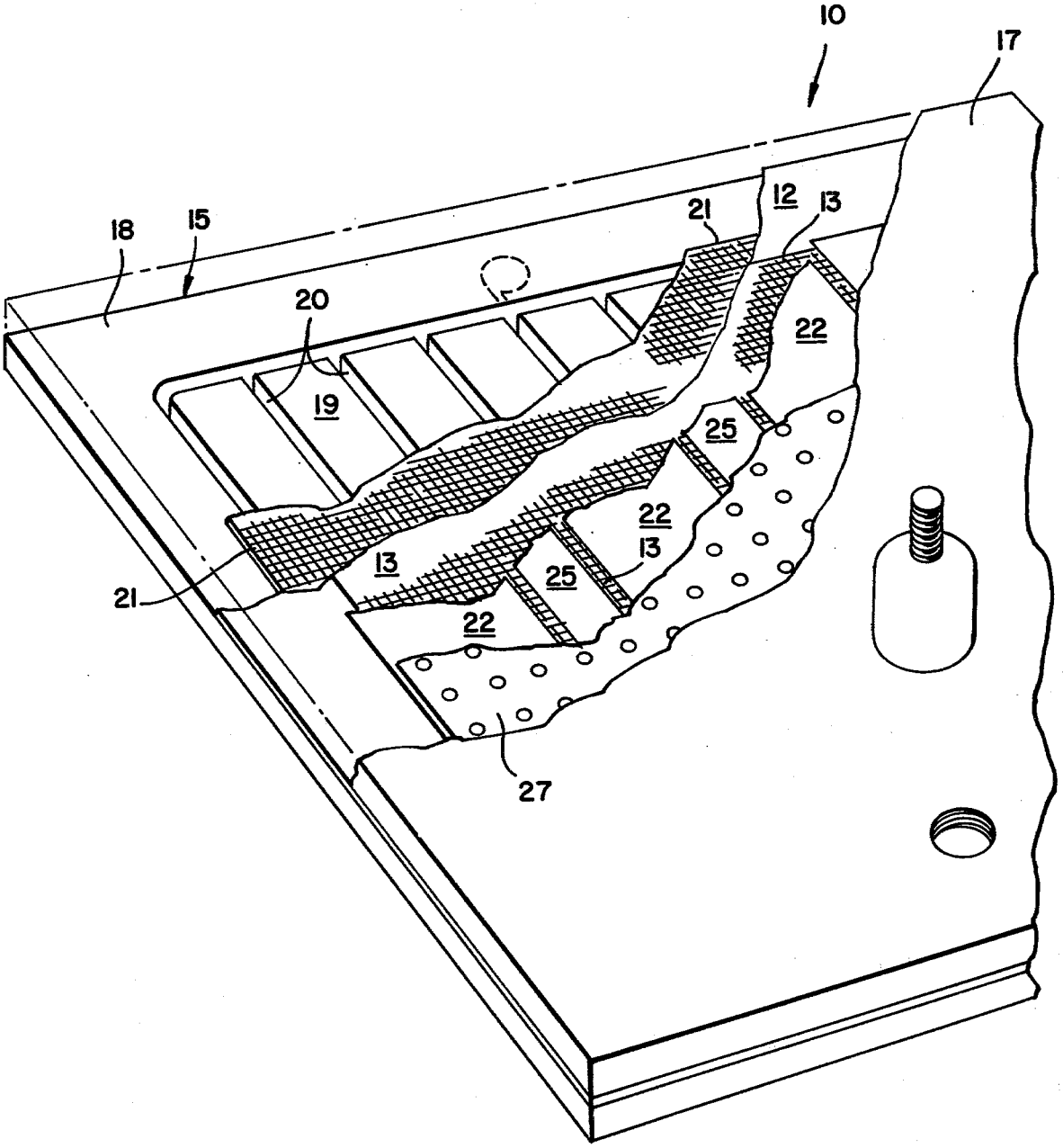
FIG. 1 is an exploded, partially broken away, perspective of a cell unit in which the processes to be described herein can be performed.

FIG. 1 shows an exploded view of an electrolysis cell in which processes for producing halogens such as chlorine may be practiced. The cell assembly is shown generally at 10 and includes a membrane 12, preferably a permselective cation membrane, that separates the cell into anode and cathode chambers. A cathode electrode, preferably in the form of a layer of electrocatalytic particles 13, supported by a conductive screen 14, is in intimate contact with the upper surface of ion transporting membrane 12 by bonding it to the membrane. The anode which may be a similar catalytic particulate mass, not shown, is in intimate contact with the other side of the membrane. The cell assembly is clamped between anode current collecting backplate 15 and cathode current collecting backplate 17, both which may conveniently be made of graphite. The membrane and adjacent components, presently to be described, are clamped against the flanges 18 of the current collector backplates to hold the cell firmly in place. Anode current collector backplate 15 is recessed to provide an anolyte cavity or chamber 19 through which the anolyte is circulated. Cavity 19 is ribbed and has a plurality of fluid distribution channels 20 through which the aqueous halide solution (HCl, NaCl, HBr, etc.) is brought into the chamber and through which the halogen electrolysis product discharged at the anode electrode may be removed. Cathode current collector backplate 17 has a similar cavity, not shown, with similar fluid distribution channels.

In brine electrolysis, water is introduced into the cathode chamber along with an oxygen containing gaseous stream to provide for depolarization of the cathode. In the case of hydrogen chloride electrolysis only the oxygen bearing stream is brought into the chamber. To distribute current evenly, an anode current collecting screen 21 is positioned between the ridges in anode current collector backplate 15 and ion exchange membrane 12.

The cathode is shown generally as 13 and consists of a conductive screen, gold for example, which supports a mass of fluorocarbon bonded catalytic particles such as platinum black, etc. The screen supports the catalytic particles bonded to the membrane and provides electron current conduction through the electrode. Electron current conduction through the electrode is necessary because the cathode is covered by a layer of hydrophobic material 22, which may be a fluorocarbon such as polytetrafluoroethylene sold by the Dupont Company under its trade designation Teflon. The hydrophobic layer is deposited over cathode which is bonded to the ion exchange membrane. The hydrophobic layer prevents a water film from forming on the surface of the electrode and blocking oxygen from reaching the cathode. that is, during brine electrolysis, for example, the cathode surface is swept with water or diluted caustic to dilute the caustic formed at the cathode in order to reduce migration of highly concentrated caustic back across the membrane to the anode. By sweeping the cathode with water to dilute the caustic, a film of water may form on the surface of the electrode and block passage of oxygen to the cathode. This would prevent depolarization of the cathode and as a result, hydrogen is evolved increasing the cell voltage. During HCl electrolysis, no water is brought into the cathode chamber. However, water is formed as a result of the $Pt/O_2/H^+$ reaction at cathode which would eventually form a film masking the active catalytic sites and preventing oxygen from reaching these sites. Layer 22, being hydrophobic, prevents a water film from forming. Water beads on the surface of the hydrophobic layer leaving much of the porous, interconnected gas permeable area accessible so that oxygen diffuses through the layer and the pores into the electrode.

Since hydrophobic layer 22 is normally nonconducting, some means must be provided to make it conductive to permit electron current flow to the cathode. Layer 22 thus consists of alternate strips of Teflon 24 and strips of metal 25 such as niobium or the like. Conductive strips 25 extend along the entire length of layer 22 and are welded to screen 13. This allows current flow from the cathode through conducting strips 25 to a niobium or tantalum screen or perforated plate 27 which is in direct contact with graphite current collecting backplate 17. Perforated plate 27 may under certain circumstances be disposed of entirely or alternately a screen of expanded metal may be used in its place.

In an aternative construction which avoids the need for attaching or welding the current collecting strips to the electrode supporting screen, layer 22 is a mix of fluorocarbon hydrophobic particles such as Teflon and conductive graphite or metallic particles. If a conductive, but hydrophobic layer is used, the gold cathode supporting screen 14 may be eliminated entirely. The conductive-hydrophobic layer is pressed directly against the electrode which is bonded to the surface of the membrane. This construction has obvious advantages in that both the cost of the electrode and the complexity of the processing is reduced.

a plurality of conductive strips which form a current collecting structure for the bonded cathode. Similarly, conductive strips 25 are connected by a common lead to the negative terminal of the power source. Hydrochloric acid anolyte brought into the anode chamber is electrolyzed at anode 27 to produce gaseous chlorine and hydrogen cations ($H^+$). The $H^+$ ions are transported across cationic membrane 12 to cathode 13 along with some water and some hydrochloric acid. When the hydrogen ions reach the cathode, they are reacted with an oxygen bearing gaseous stream to produce water by $Pt/O_2H^+$ reaction, thereby preventing the hydrogen ions ($H^+$) from being discharged at the cathode as molecular hydrogen ($H_2$). The reactions in various portions of the cell are as follows:

| Anode | Reaction | Standard Electrode Potential $V_o$ | Actual @ 400 ASF |
|---|---|---|---|
| $2HCl \rightarrow Cl_2 + 2H^+ + 2e$ | (1) $Cl^-/Cl_2$ | +1.36 | ~1.5 volts |
| Across Membrane $2H^+ \times H_2O$ | | | |
| Voltage loss due to IR | | | 0.2V |
| Cathode (No Depolarization) | | | |
| $2H^+ + 2e \rightarrow H_2$ | (2) $H^+/H_2$ | 0.0 | 0 to −0.05 volts |
| Cell Voltage (Process with no Depolarization) | | +1.36 | 1.80V |
| Cathode (With Depolarization) | | | |
| $2H^+ + 1/2O_2 + 2e \rightarrow H_2O$ | (3) $Pt/O_2H^+$ | +1.23 | ~0.45 |
| Cell Voltage (Process with Depolarization) | | +0.13 | 1.35V |

The current conducting screen or perforated member is positioned between hydrophobic layer 22 and cathode current collecting backplate 17 may be fabricated of niobium or tantalum in case of hydrochloric acid electrolysis or of nickel, stainless or mild steel or any other material which is resistant or inert to caustic in the case of brine electrolysis.

As mentioned in the aforesaid Coker, et al and LaConti, et al applications, the cathode consists of a mass of conductive electrocatalytic particles which are preferably platinum black or thermally stabilized, reduced oxides of other platinum group metal particles such as oxides or reduced oxides of ruthenium, iridium, osmium, palladium, rhodium, etc., bonded with fluorocarbon particles such as Teflon to form a porous, gas permeable electrode.

Figure 2:
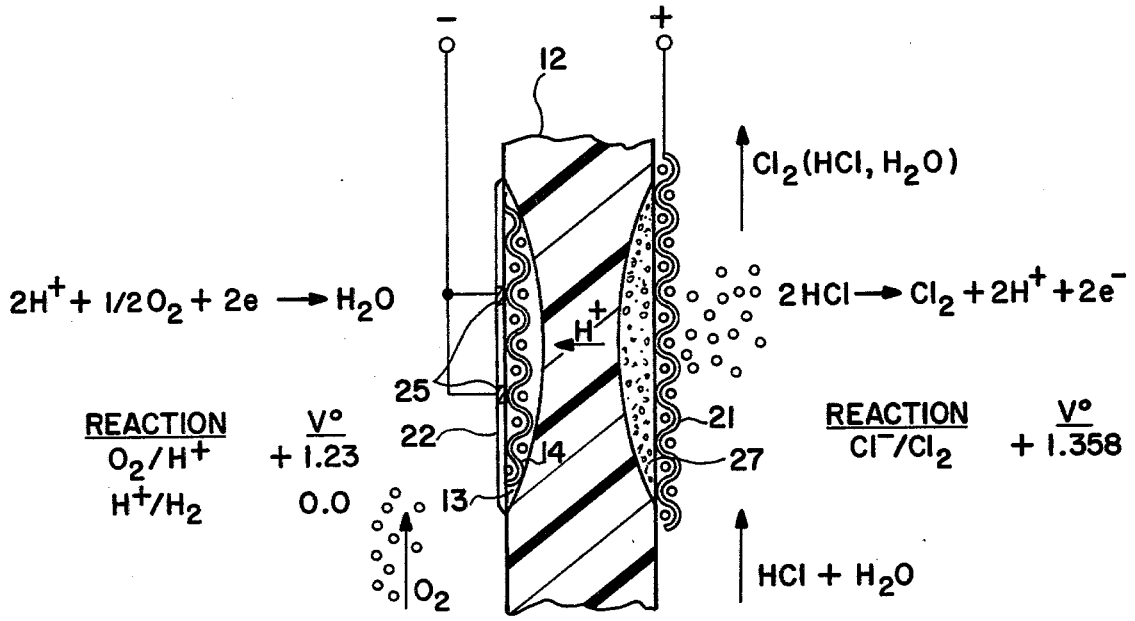
FIG. 2 is a schematic illustration of a cell and the reactions taking place in various portions of the cell during the electrolysis of hydrochloric acid.

FIG. 2 illustrates diagrammatically the reactions taking place in cell with an oxygen depolarized cathode during HCl electrolysis. An aqueous solution of hydrochloric acid is brought into the anode compartment which is separated from the cathode compartment by cationic membrane 12. An anode 27 of bonded graphite, activated by thermally stabilized, reduced platinum group oxides further stabilized by oxides (preferably reduced) of other platinum group metals and or titanium or valve metals such as tantalum, etc., is shown in intimate contact with the membrane surface. The anode is mounted on the membrane by bonding it to and preferably by embedding it in the membrane. Current collector 21 is in contact with anode electrode 27 and is connected to the positive terminal of a power source.

Cathode 13 which consists of a Teflon bonded mass of noble metal particles, such as platinum black is supported in a gold screen 14 and bonded to and preferably embedded in membrane 12. A hydrophobic layer 22, which is preferably a fluorocarbon such as Teflon, is positioned on the surface of the electrode and contains By supplying oxygen to depolarize the cathode, the reaction at the cathode is the $O_2H^+$ reaction with a standard electrode potential of +1.23 volts rather than the $H^+/H_2$ reaction at 0.0 volts. In other words, by depolarizing the cathode, the reaction is much more anodic than the hydrogen evolving reaction. The cell voltage is the difference between the standard electrode potential for chlorine discharge (+1.358) and the standard electrode potential for $O_2/H^+$ (+1.23). Thus, by depolarizing the cathode and thereby preventing hydrogen discharge, +1.23 volts (the electrode potential for the $O_2/H^+$ reaction) is theoretically gained. However, because the $O_2/H^+$ reaction is not nearly as reversible as the $H^+/H_2$ reaction, the overvoltage at the electrode results in a lesser reduction in cell voltage; i.e., 0.5 to 0.6 volts.

As pointed out previously, hydrophobic layer 22 is provided to prevent product water or water transported across the membrane from forming a film which blocks oxygen from the cathode. As oxygen is prevented from reaching the electrode by formation of the water film, hydrogen starts to be discharged at the electrode, increasing the cell voltage and power requirements of the process.

Figure 3:
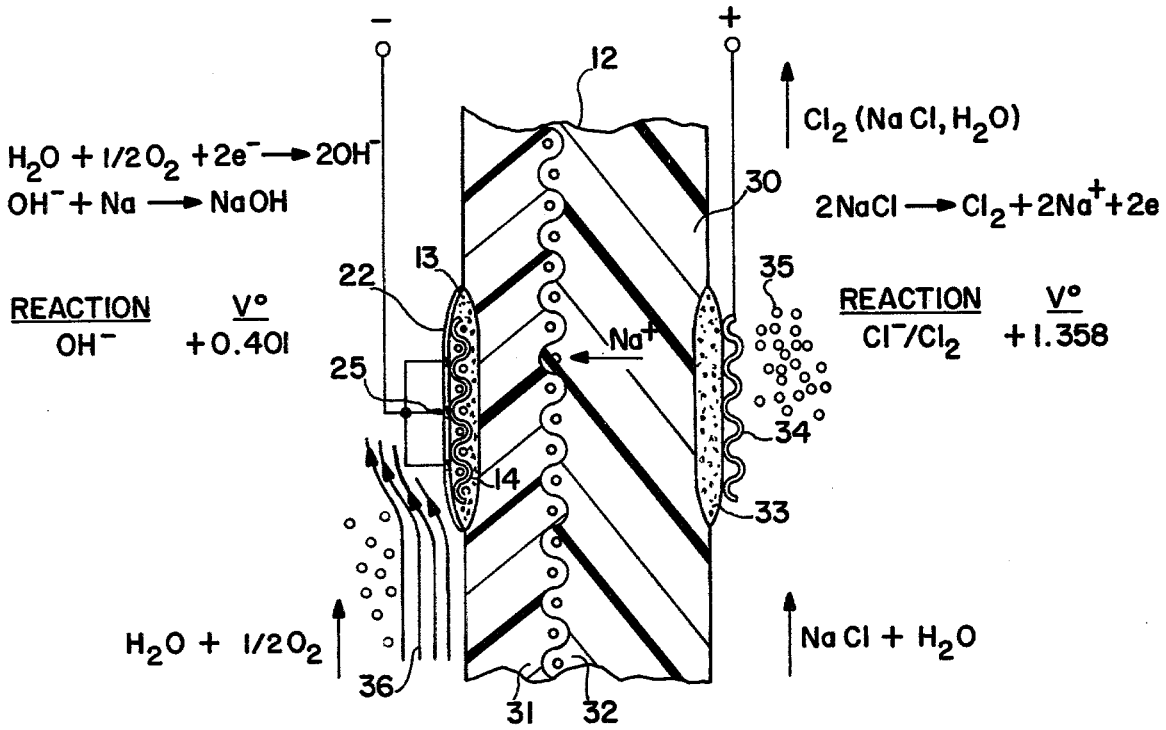
FIG. 3 is the schematic illustration of the cell and the reactions taking place in various portions of the cell during the electrolysis of aqueous alkali metal chloride.

FIG. 3 illustrates diagrammatically the reactions taking place in a cell with an oxygen depolarized cathode during brine electrolysis and is useful in understanding the electrolysis process and the manner in which it is carried out in the cell. Aqueous sodium chloride is brought into the anode compartment which is again separated from the cathode compartment by a cationic membrane 12. For brine electrolysis, membrane 12, as will be explained in detail later, is a composite membrane made up of a high water content (20 to 35% based on dry weight of membrane) anode side layer 30 and a low water content (5 to 15% based on dry weight of membrane), cathode side layer 31 separated by a Teflon cloth 32. By providing a low water content layer, the hydroxide rejection capability of the membrane is increased, reducing diffusion of sodium hydroxide back across the membrane to the anode.

The catalytic anode for brine electrolysis is a bonded, particulate mass of catalytic particles such as thermally stabilized, reduced oxides of platinum group metals. Examples of these are oxides of ruthenium, iridium, ruthenium-iridium with or without oxides or of titanium, niobium or tantalum, etc., and with or without graphite. Thermally stabilized, reduced oxides of these platinum group metal catalytic particles have been found to be particularly effective. Preferably the anode is also in intimate contact bonded to membrane 12, although this is not absolutely necessary. A current collector 34 is pressed against the surface of anode 33 and is connected to the positive terminal of a power source. Cathode 13 is a particulate mass of catalytic noble metal particles such as platinum black particles bonded to gas permeable and hydrophobic Teflon particles with the mass supported in a gold screen 14. Cathode 13 is in intimate contact with the low water content side 31 of membrane 12 by bonding it to the surface of the membrane and preferably by also embedding it into the surface of the membrane. Cathode 13 in a brine electrolysis cell is also covered by conductive hydrophobic layer 22. Layer 22 is made conductive in one instance by including current conducting niobium strips 25 in the layer. Current conductors 25 are connected to the negative terminal of the power source so that an electrolyzing potential is applied across the cell electrodes.

The sodium chloride solution brought into the anode chamber is electrolyzed at anode 33 to produce chlorine at the anode surface as shown diagrammatically by the bubbles 35. The sodium cations ($Na^+$) are transported across membrane 12 to cathode 13. A stream of water or aqueous NaOH shown at 36 is brought into the chamber and acts as a catholyte. An oxygen containing gas (such as air for example) is introduced into the chamber at a flow rate which is equal to or in excess of stoichiometric. The oxygen containing gas and water stream 31 is swept across the hydrophobic layer to dilute the caustic formed at the cathode. Since caustic readily wets Teflon, the caustic comes to the surface of layer 22 and is diluted to reduce the caustic concentration. At the same time, the hydrophobic nature of layer 22 prevents formation of a water film which could block oxygen from the electrode. Alternatively, instead of sweeping the cathode surface with the water, catholyte may be introduced by supersaturating the oxygen stream with water prior to bringing it into the cathode chamber. Water is reduced at the cathode to form hydroxyl ($OH^-$) ions which combine with the sodium ions ($Na^+$) transported across the membrane to produce NaOH (caustic soda) at the membrane/electrode interface.

| Anode | | Reaction | Standard Electrode Potential $V_o$ | Actual Volts @ 300 ASF |
|---|---|---|---|---|
| $2NaCl \rightarrow Cl_2 + 2Na^+ + 2e^-$ | (1) | $Cl^-/Cl_2$ | +1.358 | ~1.5 |
| Across Membrane $2Na^+ \times H_2O$ | | | | |
| Voltage loss due to IR | | | | 0.7V |
| Cathode (No Depolarization) | | | | |
| $2H_2O + 2e^- \rightarrow H_2 + 2OH^-$ | (2) | $OH^-/H_2$ | −0.828 | −1.1 |
| Overall (No Depolarization) | | | | |
| $2Na^+ Cl^- + H_2O \rightarrow H_2 + Cl_2 + 2NaOH$ | (3) | | | |
| | | | 2.186 | ~3.30 volts |
| Cathode (With Depolarization) | | | | |
| $H_2O + 1/2O_2 + 2e \rightarrow 2OH^-$ | (4) | $O_2/H^+$ | +0.401 | ~−0.500 |
| Overall (With Depolarization) | | | | |
| $2Na^+ Cl^+ H_2O + 1/2O_2 \rightarrow Cl_2 + 2NaOH$ | (5) | | | |
| | | | +0.957 | ~2.7 volts |

The standard electrode potential for the oxygen electrode in a caustic solution is +0.401 volts. Wate, oxygen and electrons react to produce hydroxyl ions without hydrogen discharge. In the normal reaction where hydrogen is discharged, the standard electrode potential for hydrogen discharge in caustic for unit activity of caustic is −0.828 volts. By oxygen depolarizing the cathode, the cell voltage is reduced by the theoretical 1.23 volts. Actual improvements of 0.5 to 0.6 volts are achieved because, as pointed out previously, in connection with HCl electrolysis, the overvoltage for the $O_2/H^+$ reaction is relatively high. Thus, it may readily be seen that depolarizing the cathode in brine electrolysis also results in a much more voltage efficient cell. Substantial reductions in cell voltage for electrolysis of halides is, of course, the principal advantage of this invention and has an obvious and very significant effect on the overall economics of the process.

ELECTRODES

As pointed out in the aforesaid LaConti application, the anode electrode for hydrogen halide electrolysis is preferably a particulate mass of Teflon bonded, graphite activated with oxides of the platinum metal group, and preferably temperature stabilized, reduced oxides of those metals to minimize chlorine overvoltage. As one example, ruthenium oxides, preferably reduced oxides of ruthenium, are stabilized against chlorine to produce an effective, long-lived anode which is stable in acids and has low chlorine overvoltage. Stabilization is effected by temperature stabilization and by alloying or mixing with oxides of iridium or with oxides of titanium or oxides of tantalum. Ternary alloys of the oxides of titanium, ruthenium and iridium are also very effective as a catalytic anode. Other valve metals such as niobium, zirconium or hafnium can readily be substituted for titanium or tantalum.

The alloys and mixtures of the reduced noble metal oxides of ruthenium, iridium, etc., are blended with Teflon to form a homogeneous mix. They are then further blended with a graphite-Teflon mix to form the noble metal activated graphite structure. Typical noble metal loadings for the anode are 0.6 mg/cm$^2$ of electrode surface with the preferred range being between 1 to 2 mg/cm$^2$.

The cathode is a particulate mass of Teflon bonded noble metal particles with noble metal loadings of 0.4 to 4 mg/cm$^2$ platinum black or oxides and reduced oxides of platinum, platinum-iridium, platinum-ruthenium with or without graphite may be utilized, inasmuch as the cathode is not exposed to high hydrochloric acid concentrations which would attack and rapidly dissolves platinum. That is the case because any HCl at the cathode transported across the membrane with the $H^+$ ions is normally at least ten times more dilute than the anolyte HCl.

For brine electrolysis, the preferred anode construction is a bonded particulate mass of Teflon particles and temperature stabilized, reduced oxides of a platinum group metal. The preferred platinum group metal oxide is ruthenium oxide or reduced ruthenium oxides to minimize the anode chlorine overvoltage. The catalytic ruthenium oxide particles are stabilized against chlorine, initially by temperature stabilization, and further, by mixing and/or alloying with oxides of iridium, titanium, etc. A ternary alloy of the oxides or reduced oxides or reduced oxides of Ti—Ru—Ir or Ta—Ru—Ir bonded with Teflon is also effective in producing a stable, long lived anode. Other valve metals such as niobium, tantalum, zirconium, hafnium can readily be substituted for titanium in the electrode structure.

As pointed out in the aforesaid Coker application, the metal oxides are blended with Teflon to form a homogeneous mix with the Teflon content being 15 to 50% by weight. The Teflon is the type sold by Dupont under its trade designation T-30 although other fluorocarbons may be used with equal facility.

The cathode is preferably a bonded particulate mass of Teflon particles and noble metal particles of the platinum group such as platinum black, graphite and temperature stabilized, reduced oxides of Pt, Pt—Ir, Pt—Ru, Pt—Ni, Pt—Pd, Pt—Au, as well as Ru, Ir, Ti, Ta, etc. Catalytic loadings for the cathode are preferably from 0.4 to 4 mg/cm$^2$ of cathode surface. The cathod electrode is in intimate contact with the membrane surface by bonding and/or embedding it in the surface of the membrane. The cathode is constructed to be quite thin, 2 to 3 mils or less, and preferably approximately 0.5 mils. The cathode electrode like the anode is porous and gas permeable. The Teflon deposited over the surface of the electrode is preferably 2 to 10 mils in thickness and in the embodiment shown in FIG. 1 is deposited over the particulate mass 13 supported by screen 14. Conductive niobium strips 25 are spot welded to the screen and solid strips of porous Teflon film are deposited in the spaces between the current collector strips. This results in a generally homogeneous layer which consists of alternate strips of Teflon films and of niobium current collector.

The Teflon layer has a density of 0.5 to 1.3 g/cc and a pore volume of 70 to 95%. The size of the unconnected pores in the Teflon layer ranges from 10 to 60 microns. With such a construction, an air flow of 500 to 2500 cc/sec./in$^2$, at $\Delta P=0.2$ PSI, can readily be maintained through the film.

The catalytic oxide or reduced oxide particles as described in the aforesaid LaConti and Coker applications are prepared by thermally decomposing mixed metal salts. The actual method is a modification of the Adams method of platinum preparation by the inclusion of thermally decomposable halides of the various noble metals, i.e., such as chloride salts of these metals, in the same weight ratio as desired in the alloy. The mixture, with an excess of sodium nitrate, is then fused at 500° in a silica dish for three hours. The suspension of mixed and alloyed oxides is reduced at room temperature either by electrochemical reduction techniques or by bubbling hydrogen through the mixture. The reduced oxides are thermally stabilized by heating at a temperature below that at which the reduced oxides begin to be decomposed to the pure metal. Thus, preferably the reduced oxides are heated at 350°–750° from thirty (30) minutes to six (6) hours with the preferable thermal stabilization procedure being accomplished by heating the reduced oxides at 550°–600° C. for approximately 1 hour. The electrode is prepared by mixing the thermally stabilized, reduced platinum metal oxides with the Teflon particles. The mixture is then placed in a mold and heated until the composition is sintered into a decal form to form a bonded, particulate mass. This particulate mass or decal is then bonded to and preferably embedded in the surface of the membrane by application of pressure and heat.

In a hydrogen chloride electrolysis cell, the anode is prepared by first mixing powdered graphite, such as that sold by Union Oil Company under the designation of Poco graphite 1748, with 15% to 30% by weight od Dupont Teflon T-30 particles. The reduced platinum group metal oxide particles are blended with the graphite-Teflon mixture, placed in a mold and heated until the composition is sintered into a decal form which is then brought into intimate contact with the membrane by bonding and/or embedding the electrode to the surface of the membrane by the application of pressure and heat.

MEMBRANE

The membranes, as pointed out previously, are preferably stable, hydrated membranes which selectively transport cations while being substantially impermeable to the flow of liquid anolyte or catholyte. There are various types of ion exchange resins which may be fabricated into membranes to provide selective transport of the cation. Two well-known classes of such resins and membranes are the sulfonic acid cation exchange resins and the carboxylic cation exchange resins. In the sulfonic acid exchange resins, the ion exchange groups are hydrated sulfonic acid radicals ($SO_3H.xH_2O$) which are attached to the polymer backbone by sulfonation. Thus, the ion exchanging radicals are not mobile within the membranes ensuring that electrolyte concentration does not vary. One such class of sulfonic acid cation polymer members which is stable, has good ion transport, is not affected by acids or strong oxidants is available from the Dupont Company under its trade designation "Nafion". Nafion membranes are hydrated copolymers of polytetrafluoroethylene (PTFE) and polysulfonyl fluoride vinyl ether containing pendant sulfonic acid groups. For hydrochloric acid electrolysis, one preferred form of the ion exchange membrane is a low milliequivalent weight (MEW) membrane sold by the Dupont Company under its trade designation Nafion 120, although other membranes with different milliequivalent of the $SO_3$ radical may also be used.

In brine electrolysis, it is necessary that the cathode side of the membrane have good hydroxide, ($OH^-$) rejection to prevent or minimize back migration of the caustic to the anode side. Hence, a laminated membrane is preferred which has an anion barrier layer on the cathode side which has good $OH^-$ rejection (high MEW, low ion exchange capacity). The barrier layer is bonded to a layer which has lower MEW and a higher ion exchange capacity. One form of such a laminate construction is sold by the Dupont Company under its trade designation Nafion 315. Other laminates or constructions are available such as Nafion 376, 390, 227 in which the cathode side consists of a thin, low water content (5 to 15%) layer for good $OH^{31}$ rejection. Alternately, laminated membranes may be used in which the cathode side is converted by chemical treatment to a weak acid form (such as sulfonamide) which has a good $OH^-$ rejection characteristic.

PROCESS PARAMETERS

In hydrogen chloride electrolysis, the aqueous hydrochloric acid feedstock concentration should exceed 3 N with the preferred range being 9 to 12 N. The feed rate is in the range of 1 to 4 L/min/ft-sq. Operating potential in the range of 1.1 to 1.4 volts at 400 amperes per sq ft is applied to the cell and the cell feedstock is maintained at 30° C., i.e., room temperature. The oxygen containing gas stream feed rate should at least equal stoichiometric, ~1500 cc/min/ft$^2$ of cathode surface.

In brine electrolysis, the aqueous metal chloride solution (NaCl) feed rate is preferably in the range of 200 to 2000 cc/min/ft$^2$/100 ASF. The brine concentration should be maintained in the range of 3.5 to 5 M (150 to 300 grams/liter), with a 5 molar solution at 300 grams per liter being preferred, since the cathodic current efficiency increases directly with feedstock concentration. The water is introduced at the catholyte and decomposed to the hydroxyl ions. The water also provides a sweep of the electrode layer to reduce the caustic concentration.

Both in hydrochloric acid and brine electrolysis, an oxygen bearing gaseous stream (preferably air, although other carrier gases may be utilized) is introduced into the cathode at a feed rate which is at least equal to the stoichiometric rate (i.e., ~1500 cc/min/ft$^2$ of cathode surface to depolarize the cathode and prevent a hydrogen discharge. A feed rate in excess of stoichiometric (1.5 to 3) should be used in most instances.

The brine solution is preferably acidified with HCl to minimize oxygen evolution at the anode due to the back migrating caustic. By adding at least 0.25 molar HCl to the brine feedstock, the oxygen level is reduced to less than 0.5%. An operating potential of 2.9–3.3 volts, depending on the membrane and electrode composition, at 300 amperes per sq. ft. is applied to the cell and the feedstock is preferably maintained at a temperature from 70° to 90° C.

EXAMPLES

Cells incorporating ion exchange membranes having cathodes bonded to the membrane were built and tested both for hydrogen chloride and brine electrolysis to determine the effect of oxygen depolarization of the cathode on the cell voltage and to determine the effect of such other parameters as feedstock concentration, current density, etc.

Cells were constructed for HCl electrolysis using a Nafion 120 membrane. The anode was a graphite-Teflon particulate mass activated with temperature stabilized, reduced oxides of a platinum group metal, specifically a ruthenium (47.5% by weight)—iridium (5% by weight)—titanium (47.5% by weight) oxide ternary alloy. The anode loading was 1 mg/cm$^2$ of Ru—Ir—Ta and 4 mg/cm$^2$ of graphite. The anode electrode was placed in direct contact with a graphite anode endplate current collector having a plurality of raised portions or ribs in contact with the anode electrode. The cathode was a particulate mass of Teflon bonded platinum black electrocatalyst particles. An electrode structure of conductive graphite mixed with a hydrophobic binder such as Teflon was positioned on the surface on the Teflon bonded platinum black cathode. A conductive graphite Teflon sheet was positioned directly between the electrode and a ribbed graphite cathode endplate current collector. HCl feedstock maintained at approximately 30° C. (i.e., room temperature) was introduced into the anolyte chamber at a rate of 2400 cc/min/ft$^2$ (i.e., ~1.6 stoichiometric). The following data was obtained:

| Current Density (ASF) | Cell Voltage | HCl Normality (Eq 16) | % $H_2$ in Cathode $O_2$ Effluent |
|---|---|---|---|
| 60 | 0.94 | 9.6 | |
| 100 | 1.00 | 9.6 | Not taken |
| 200 | 1.11 | 9.6 | |
| 300 | 1.22 | 9.6 | |
| 400 | 1.35 | 9.6 | |
| 400 | 1.23 | 7.7 | <0.01 |
| 400 | 1.23 | 8.1 | <0.01 |
| 400 | 1.35 | 9.6 | <0.01 |
| 400 | 1.30 | 10.9 | <0.01 |
| 400 | 1.30 | 10.9 | <0.0 |
| 600 | 1.50 | 10.9 | 0.1 |

Table I illustrates the effect on cell voltages of current density, feed normality and also illustrates the effectiveness of the process in reducing hydrogen evolution at the cathode by measuring the percentage of hydrogen in the oxygen effluent removed from the catholyte chamber.

It can be readily observed from this data that the cell operating potentials for hydrochloric acid electrolysis with an oxygen depolarized cathode are in the range of 1.23 to 1.35 for 400 ASF. At low current density, less oxygen is needed at the cathode to support $O_2/H^+$ reaction at the catalytic sites and very little hydrogen is discharged. The cell voltage at 60 ASF is as low as 0.94 volts. As the current density increases, more hydrogen is generated and the cell voltage goes up. However, even at 400 ASF the voltage is at least 0.6 volts lower than the cell voltage possible with the system and the cell described in the aforesaid LaConti application which in itself is 0.6 of a volt or more better than commercially available hydrochloric acid electrolysis processes and cells.

The $O_2$ effluent was tested to determine the hydrogen content by the use of a gas chromatograph. With current density of 400 ASF or less, less than one hundredth of 1% (0.01%) of hydrogen was evolved; 0.01% was the $H_2$ detection limit of the chromatograph. When the current density is increased to 600 ASF, the hydrogen content in the $O_2$ effluent increased by at least an order of magnitude to one-tenth of a percent (0.1%). The cell voltage at 600 ASF rose to 1.50 volts but even at this extremely high current density, the cell voltage is still a vast improvement over the cell voltage without any depolarizing of the cathode and the $H_2$ concentration in the $O_2$ effluent, although increased, is still very low.

BRINE

For electrolysis of brine, a cell was built having a Teflon bonded platinum black cathode on a gold support screen with a non-wetting support Teflon film over the electrode surface. The cathode was bonded to and embedded to a Nafion 315 laminate membrane. A Teflon-bonded ruthenium oxide-graphite anode was bonded to the other side of the membrane. A brine feedstock at 90° C. was introduced and the cell operated at a current density of 300 ASF. The process was carried out with a cell voltage of 2.7 volts with a cathode current efficiency of 69% at 0.9 M NaOH with an oxygen feed of 2000 cc per min. or ~9.6 stoichiometric.

The same cell operated without oxygen depolarization, i.e., in hydrogen evolution mode had a cell voltage of 3.3 volts at 300 ASF and 90° C. with a current efficiency of 64% at 0.8 M NaOH. The same cell was then operated at various current densities both in the oxygen depolarized cathode mode under the same conditions and with $H_2$ evolution. The cell voltages as a function of current density is illustrated in Table II below:

| Current Density (ASF) | Cell Voltage (V) (Depolarized) | Cell Voltage (V) (Not Depolarized) |
|---|---|---|
| 50 | 1.64 | 2.44 |
| 100 | 2.02 | 2.60 |
| 200 | 2.46 | 2.96 |
| 300 | 2.70 | 3.30 |
| 400 | 2.95 | 3.60 |

It can be seen from this data, as current density increases, the cell voltage increases because, as pointed out previously, the lower the current density, the less oxygen must get to the catalytic sites at the cathode to maintain the desired reaction and limit hydrogen evolution. As current increases, more hydrogen is generated and the cell voltage increases. But still, it is clearly apparent that depolarization of the cathode even over a wide range of current densities results in a 0.6 to 0.7 volt improvement.

A cell similar to the one described above was constructed with the cathode bonded to and embedded in the surface of a Nafion 315 membrane. The cathode was platinum black Teflon bonded catalyst with a nickel support screen and a non-wetting porous Teflon film. This cell differed from the other one in that the anode was not bonded to the membrane surface. The anode consisted of a platinum clad niobium screen positioned against the membrane. The cell voltage of this assembly at 300 ASF with a brine feedstock maintained at 90° C. was 3.6 volts when operated with an oxygen feed of 2000 cc/min or ~9.6 stoichiometric to depolarize the cathode. The same cell operating in the hydrogen evolution mode at 300 ASF, i.e., without an oxygen feed required a cell voltage of 4.3 volts. Thus, there is a 0.7 volt improvement with cathode depolarization. This cell was then operated at various current densities, both with and without oxygen depolarization. Cell voltage as a function of current density is illustrated in Table III below:

TABLE III

| Current Density (ASF) | Cell Voltage (V) (Depolarized) | Cell Voltage (V) (Not Depolarized) |
|---|---|---|
| 50 | 1.80 volts | 2.26 volts |
| 100 | 2.28 volts | 2.74 volts |
| 200 | 3.16 volts | 3.72 volts |
| 300 | 3.6 volts | 4.3 volts |

It is readily apparent oxygen depolarization of the cathode in brine electrolysis results in substantial improvement in the order of 0.6 to 0.7 of a volt over operation of the process under the same conditions without oxygen depolarization. The process is even more voltage efficient when in addition to oxygen depolarization of the cathode, the process is carried out in a cell in which both the cathode and anode are in intimate contact with the membrane by bonding and/or embedding.

It will be appreciated that a vastly superior process for generating halogens, e.g., chlorine, from halide solutions such as hydrochloric acid and NaCl, is possible by carrying the process out in a cell in which the cathode is bonded to and preferably embedded in an ion exchange membrane and the cathode is depolarized by an oxygen containing gaseous stream. The cell voltage is significantly lower than that of known industrial process cells and better by half a volt or more than the improved processes disclosed in the aforesaid LaConti and Coker applications.

While the instant invention has been shown in connection with certain preferred embodiments thereof, the invention is by no means limited thereto since other modifications of the instrumentalities employed and of the steps of the process may be made and still fall within the scope of the invention. It is contemplated by the appended claims to cover any such modifications that fall within the true scope and spirit of this invention.

What we claim is new and desired to be secured by Letters Patent of the United States is:

1. A process of generating halogens by the electrolysis of aqueous halides which comprises electrolyzing an aqueous halide between an anode and a cathode electrode separated by an ion exchanging liquid and gas impervious membrane, said cathode comprising electroconductive catalytic material bonded to said membrane to provide a gas permeable electrode which forms part of a unitary electrode-membrane structure, applying a potential to the electrodes through separate electron conductive current collectors in physical contact with the electrochemically active catalytic material, passing an oxygen containing gaseous stream over said cathode to depolarize the cathode to prevent hydrogen evolution at said cathode.

2. The process of claim 1 wherein the electrocatalyst is covered by a porous hydrophobic layer to prevent the formation of a water film over said electrode to ensure thereby penetration of oxygen to the electrocatalyst.

3. The process of claim 1 wherein the cathode catalyst comprises a mass of particles of a platinum group metal.

4. The process of claim 3 wherein said platinum group metal particles include reduced thermally stabilized electroconductive oxides thereof.

5. The process of claim 4 wherein said bonded catalytic cathodes are covered by a hydrophobic conductive film.

6. The process of claim 1 wherein said electrocatalytic material in said cathode is supported in a conductive screen.

7. The process of claim 6 wherein the screen supported catalytic material in said cathode is covered by a hydrophobic film.

8. The process of claim 1 wherein the anode comprises an electrocatalytic material bonded to the surface of said membrane.

9. The process of claim 8 wherein said bonded electrocatalytic material in the anode comprises a mass of particles of a platinum group metal.

10. The process of claim 9 wherein said platinum group electrocatalytic particles include electroconductive reduced oxides thereof.

11. The process of claim 1 wherein oxygen is supplied to the cathode is at least at the stoichiometric rate for water formation.

12. The process of claim 11 wherein the oxygen flow to the cathode ranges between 1.5 and 3 times stoichiometric.

13. A process of generating chlorine which comprises electrolyzing an aqueous solution of hydrochloric acid between an anode and cathode electrode separated by an ion exchanging membrane said cathode comprising a layer of catalytic particles bonded to the ion exchanging membranes to provide a gas permeable electrode which forms a unitary electrode-membrane structure, applying a potential to the electrodes through separate electron conductive current collectors in physical contact with the electrochemically active actalytic particles, passing an oxygen containing gaseous stream over said cathode to depolarize the electrode cathode to form water and thereby prevent hydrogen discharge at said cathode, and said anode electrode comprises a plurality of electrocatalytic particles bonded to the surface of the ion exchange membrane to provide a gas and electrolyte permeable electrode.

14. The process of claim 13 wherein the catalytic particles in said bonded anode electrode consists of graphite particles and particles of a platinum group metal.

15. The process of claim 14 wherein the platinum group metal particles include electroconductive oxides thereof.

16. The method according to claim 14 wherein said bonded cathode electrode is covered by a conductive hydrophobic layer.

17. The process of claim 13 wherein the bonded cathode electrode is covered by a hydrophobic layer to prevent formation of an oxygen blocking water film on said electrode.

18. The process of claim 13 wherein oxygen is supplied to the cathode at a rate in excess of 1.5 stoichiometric.

19. The process of claim 18 wherein the oxygen flow to the cathode is maintained in the range between 1.5 to 3 stoichiometric.

20. The process for generating chlorine and alkali which comprises electrolyzing an aqueous alkali metal chloride between an anode and a cathode separated by an ion exchanging membrane, at least the cathode electrode comprising a plurality of electroconductive catalytic particles bonded to said membrane to provide a gas and electrolyte permeable electrode to form a unitary electrode-membrane structure, applying a potential to the electrode through a separate electron conductive current collector in physical contact with the electrochemically active catalytic material bonded to the membrane, passing oxygen bearing gaseous stream to said cathode electrode to depolarize said electrode and to prevent hydrogen discharge at said electrode, said anode comprises a mass of electrocatalytic particles bonded to the surface of the ion exchange membrane.

21. The process of claim 20 wherein the catalytic particles in the anode are particles of a platinum group metal.

22. The process of claim 21 wherein the noble metal particles in the anode are electroconductive oxides of said platinum group metal.

23. The process of claim 22 wherein the noble metal particles are reduced oxides of the noble metal.

24. The process of claim 20 wherein oxygen is supplied to the cathode at a rate in excess of 1.5 stoichiometric.

25. The process of claim 24 wherein the oxygen flow rate to the cathode ranges between 1.5 and 3 stoichiometric.

* * * * *